US008876675B2

(12) United States Patent
Califano

(10) Patent No.: US 8,876,675 B2
(45) Date of Patent: Nov. 4, 2014

(54) METHOD AND APPARATUS FOR KNEE STRENGTHENING

(76) Inventor: Christopher J. Califano, Locust Valley, NY (US)

( * ) Notice: Subject to any disclaimer, the term of this patent is extended or adjusted under 35 U.S.C. 154(b) by 820 days.

(21) Appl. No.: 11/765,042

(22) Filed: Jun. 19, 2007

(65) Prior Publication Data

US 2008/0318742 A1 Dec. 25, 2008

(51) Int. Cl.

| | |
|---|---|
| ***A63B 21/02*** | (2006.01) |
| ***A63B 23/04*** | (2006.01) |
| ***A63B 21/00*** | (2006.01) |
| *A63B 21/055* | (2006.01) |

(52) U.S. Cl.

CPC ..... *A63B 23/0494* (2013.01); *A63B 21/0552* (2013.01); *A63B 21/154* (2013.01); *A63B 21/143* (2013.01)

USPC ..... 482/121

(58) Field of Classification Search

USPC ..... 482/121, 74, 91, 148

See application file for complete search history.

(56) References Cited

U.S. PATENT DOCUMENTS

| | | | | | |
|---|---|---|---|---|---|
| 1,144,085 | A | * | 6/1915 | Abplanalp | 482/95 |
| 2,183,265 | A | * | 12/1939 | Maloney | 482/95 |
| 2,832,595 | A | * | 4/1958 | Hastings | 482/131 |
| 3,117,782 | A | * | 1/1964 | Johnston | 482/95 |
| 3,462,142 | A | | 8/1969 | Sterndale | |
| 3,606,321 | A | * | 9/1971 | Macoulis | 482/122 |
| 3,677,543 | A | | 7/1972 | Richardson | |
| 3,834,694 | A | * | 9/1974 | Pridgen | 482/102 |
| 3,979,114 | A | * | 9/1976 | Codina | 482/131 |
| 3,982,756 | A | * | 9/1976 | Hersey et al. | 482/131 |
| 4,019,734 | A | | 4/1977 | Lee et al. | |
| 4,060,240 | A | * | 11/1977 | Dunston | 482/131 |
| 4,084,815 | A | * | 4/1978 | Flannery | 482/94 |
| 4,205,839 | A | * | 6/1980 | Best | 482/131 |
| 4,245,839 | A | * | 1/1981 | Trent | 482/92 |
| 4,245,840 | A | * | 1/1981 | Van Housen | 482/124 |
| 4,257,592 | A | * | 3/1981 | Jones | 482/131 |
| 4,290,598 | A | * | 9/1981 | Flannery | 482/94 |
| 4,304,401 | A | | 12/1981 | Goodman | |
| 4,372,553 | A | * | 2/1983 | Hatfield | 482/105 |
| 4,411,426 | A | * | 10/1983 | McCoy et al. | 482/131 |
| 4,909,505 | A | * | 3/1990 | Tee | 482/129 |
| 4,930,767 | A | | 6/1990 | Hamm | |
| 4,974,836 | A | * | 12/1990 | Hirsch | 482/40 |
| 5,067,709 | A | * | 11/1991 | Christianson | 482/95 |
| 5,076,576 | A | * | 12/1991 | Johnston | 482/95 |
| 5,149,314 | A | * | 9/1992 | Ciolino et al. | 482/111 |
| 5,176,602 | A | * | 1/1993 | Roberts | 482/131 |
| 5,181,895 | A | * | 1/1993 | Larson et al. | 482/93 |
| 5,230,679 | A | * | 7/1993 | Olsen | 482/91 |
| 5,253,639 | A | * | 10/1993 | Johnston | 601/34 |
| 5,263,916 | A | | 11/1993 | Bobich | |
| 5,277,680 | A | * | 1/1994 | Johnston | 482/95 |
| 5,277,683 | A | * | 1/1994 | Wilkins | 482/129 |
| 5,284,131 | A | * | 2/1994 | Gray | 601/36 |

(Continued)

*Primary Examiner* — Robert Long

(74) *Attorney, Agent, or Firm* — Ryan, Mason & Lewis, LLP

(57) ABSTRACT

An exercise device and method of use is provided. The exercise device includes an elongated elastic element having a first end and a second end. The elongated elastic element is stretchable along its length. The exercise device further includes a pulley system comprising a pulley having a channel along its outer circumference through which the elongated elastic element runs. An engagement mechanism removably anchors the pulley to a fixed point while allowing the pulley to rotate as the elongated elastic element passes through the channel.

17 Claims, 5 Drawing Sheets

(56) References Cited

U.S. PATENT DOCUMENTS

| | | | | | |
|---|---|---|---|---|---|
| 5,286,242 | A * | 2/1994 | Johnston | 482/95 |
| 5,303,716 | A * | 4/1994 | Mason et al. | 601/34 |
| 5,324,243 | A * | 6/1994 | Wilkinson | 482/92 |
| 5,352,174 | A * | 10/1994 | Mason et al. | 482/129 |
| 5,405,306 | A * | 4/1995 | Goldsmith et al. | 482/120 |
| 5,407,411 | A * | 4/1995 | Trainor | 482/95 |
| 5,490,823 | A * | 2/1996 | Awbrey et al. | 482/55 |
| 5,518,486 | A * | 5/1996 | Sheeler | 482/131 |
| 5,569,169 | A * | 10/1996 | Lewark, Sr. | 601/134 |
| 5,593,374 | A * | 1/1997 | Gvoich | 482/123 |
| 5,595,559 | A * | 1/1997 | Viel | 482/91 |
| 5,613,926 | A * | 3/1997 | Michaelson | 482/121 |
| 5,634,873 | A * | 6/1997 | Carlstrom | 482/95 |
| 5,643,159 | A | 7/1997 | Iavarone | |
| 5,653,668 | A * | 8/1997 | Wilkinson | 482/124 |
| 5,688,213 | A | 11/1997 | Recker | |
| 5,713,821 | A * | 2/1998 | Nissen | 482/114 |
| 5,743,838 | A * | 4/1998 | Willis | 482/124 |
| 5,807,214 | A * | 9/1998 | Riazi | 482/129 |
| 5,813,954 | A * | 9/1998 | Wilkinson | 482/124 |
| 5,820,532 | A | 10/1998 | Oliver | |
| 5,857,949 | A * | 1/1999 | Tebbe et al. | 482/140 |
| 6,059,698 | A * | 5/2000 | Mazor | 482/79 |
| 6,099,445 | A | 8/2000 | Rovinsky et al. | |
| 6,110,083 | A * | 8/2000 | Riser | 482/142 |
| 6,117,056 | A * | 9/2000 | Cataldi et al. | 482/121 |
| 6,142,919 | A * | 11/2000 | Jorgensen | 482/121 |
| 6,299,569 | B1 | 10/2001 | Rich | |
| 6,322,483 | B1 * | 11/2001 | Rotella | 482/129 |
| 6,361,516 | B1 * | 3/2002 | Hamel | 602/27 |
| 6,390,957 | B1 * | 5/2002 | Knight | 482/79 |
| 6,422,981 | B1 * | 7/2002 | Riser | 482/142 |
| 6,425,844 | B1 | 7/2002 | Azar | |
| 6,450,929 | B1 | 9/2002 | Markham | |
| 6,450,930 | B1 * | 9/2002 | Kroke | 482/121 |
| 6,592,502 | B1 * | 7/2003 | Phillips | 482/143 |
| 6,648,804 | B2 | 11/2003 | Chen | |
| 6,662,651 | B1 * | 12/2003 | Roth | 73/379.02 |
| 6,666,801 | B1 * | 12/2003 | Michalow | 482/137 |
| 6,705,974 | B1 * | 3/2004 | Tardif | 482/39 |
| 6,872,170 | B2 * | 3/2005 | Kuo | 482/71 |
| 6,887,187 | B1 * | 5/2005 | Renz | 482/57 |
| 6,908,418 | B2 * | 6/2005 | Saure | 482/121 |
| 7,022,054 | B2 * | 4/2006 | Contreras | 482/131 |
| 7,041,040 | B2 * | 5/2006 | Dovner et al. | 482/124 |
| 7,044,898 | B2 * | 5/2006 | Kuo et al. | 482/121 |
| D526,367 | S * | 8/2006 | Loccarini et al. | D21/662 |
| 7,137,935 | B2 * | 11/2006 | Clarke et al. | 482/123 |
| 7,175,574 | B2 * | 2/2007 | Carmel et al. | 482/124 |
| 7,322,909 | B1 * | 1/2008 | Loccarini et al. | 482/129 |
| 7,494,453 | B2 * | 2/2009 | Wehrell | 482/124 |
| 7,618,356 | B1 * | 11/2009 | Johnson et al. | 482/124 |
| 2002/0137609 | A1 * | 9/2002 | Rosati | 482/126 |
| 2004/0002412 | A1 * | 1/2004 | Kuo | 482/123 |
| 2004/0204302 | A1 * | 10/2004 | Flynn | 482/124 |
| 2005/0233875 | A1 | 10/2005 | Clarke et al. | |
| 2006/0135329 | A1 * | 6/2006 | Owen | 482/123 |
| 2008/0058180 | A1 * | 3/2008 | Clarke et al. | 482/126 |
| 2008/0081747 | A1 * | 4/2008 | Mok | 482/121 |
| 2008/0096737 | A1 * | 4/2008 | Ayoub | 482/107 |
| 2009/0149303 | A1 * | 6/2009 | Meisterling | 482/124 |
| 2010/0113231 | A1 * | 5/2010 | Kopp | 482/124 |

* cited by examiner

METHOD AND APPARATUS FOR KNEE STRENGTHENING

FIELD OF THE INVENTION

The present invention relates to an exercise device and method of use and, more particularly, to an exercise device for knee strengthening.

BACKGROUND OF THE INVENTION

Within the fields of medical care and devices, there exists an important unmet medical need for a simple yet effective knee muscle strengthening device. Such strengthening may act to prevent surgery for those who have injured their knee. The universally accepted method for strengthening the knee involves the strengthening of the vastus medialis muscle, whose weakness is responsible for 99% of all chronic knee injuries. See, for example, A. A. Halpern, "The Runner's World Knee Book, What Every Athlete Needs to Know about the Prevention and Treatment of Knee Problems," New York, Collier Books, 1984. Unfortunately, most people suffering from knee pain do not understand how to properly strengthen their knee and often wait too long to treat their injury. This combined with inconvenient, painful, useless or expensive treatment options may lead to situations in which those with injured knees view invasive surgery as their only option.

Knee strengthening methods require proper performance of the knee extension or leg extension exercise from an eccentric or stretched position to a concentric or contracted position of the muscles surrounding the knee, mainly the vastus medialis muscle. The main touchstone by which any strengthening program must be judged and which is universally accepted is specificity, overload, progression and regularity (SOPR).

The resistance must be specifically applied by selecting the proper movement. In the case of knee strengthening, it is the leg extension exercise targeting the vastus medialis and surrounding muscles. Overload stimulus must be applied in order to get a training effect or strengthening of the muscles and surrounding knee structures over time. This time may range from six weeks to three months, with results being achieved sooner if the trainee is diligent in performing their exercise. Overload is accomplished by slow but steady continual application of resistance each time the knee extension exercise is performed on a regular basis. Resistance should be easily controlled in the smallest increment possible by the user in order to gently but surely micro-load the muscles and surrounding knee structures over time. This micro-loading technique is highly respected and used to guarantee the quickest desired training effect without injury, as well as to motivate and safely train athletes.

Existing products range from leg extension machines to simple elastic tubing or ankle weights with vague instructions. Leg extension tables are large and expensive and, aside from the most costly commercial units, lack the gentle yet effective variable resistance and proper bio-mechanics. Thus, devices and techniques are needed that secure variable resistance in such a way as to make the knee-extension exercise bio-mechanically correct. It is also desirable to have a device with a resistance that is adjustable by the user at all times, and that is inexpensive and convenient enough that all those in need of help may benefit.

SUMMARY OF THE INVENTION

The present invention, in illustrative embodiments thereof, provides a system and method for strengthening the muscles around the knee through a leg extension exercise with an exercise device having an elongated elastic element and a pulley system.

In accordance with one aspect of the present invention, an exercise device is provided. The exercise device includes an elongated elastic element having a first end and a second end. The elongated elastic element is stretchable along its length. The exercise device further includes a pulley system comprising a pulley having a channel along its outer circumference through which the elongated elastic element runs. An engagement mechanism removably anchors the pulley to a fixed point while allowing the pulley to rotate as the elongated elastic element passes through the channel.

In additional embodiments of the present invention, the first and second ends of the elongated elastic element may have body engaging members. Further, the engagement mechanism may include at least a first element removably connected to a housing of a pulley. At least a portion of the first element is wider than a defined width, such that the first element is prohibited from passing through a specified aperture.

In another aspect of the present invention, a method of performing a knee extension exercise is provided. A foot of a user is inserted through a body engaging member at a first end of an elongated elastic element stretchable along its length. The user is in a seated position with the foot elevated above a floor. A second end of the elongated elastic element is held in a hand of the user. The leg of the user is extended at the knee of the user so that the elongated elastic element passes through a pulley system as a pulley rotates. The pulley system is anchored on a surface beneath the foot of the user.

In an additional embodiment, a resistance of the elongated elastic element may be adjusted by moving a grip of the hand of the user further along the length of the elongated elastic element from the second end.

Other aspects and advantages of the present invention will become apparent from the following detailed description, taken in conjunction with the accompanying drawings, illustrating by way of example, the principles of the invention.

DETAILED DESCRIPTION OF THE INVENTION

The embodiments of the present invention provide methods and apparatus for strengthening and developing the muscles of the thigh responsible for knee stability and resistance to injury. Such methods and apparatus are effective, inexpensive, portable, easily adjustable, safe and bio-mechanically correct.

Figure 1:
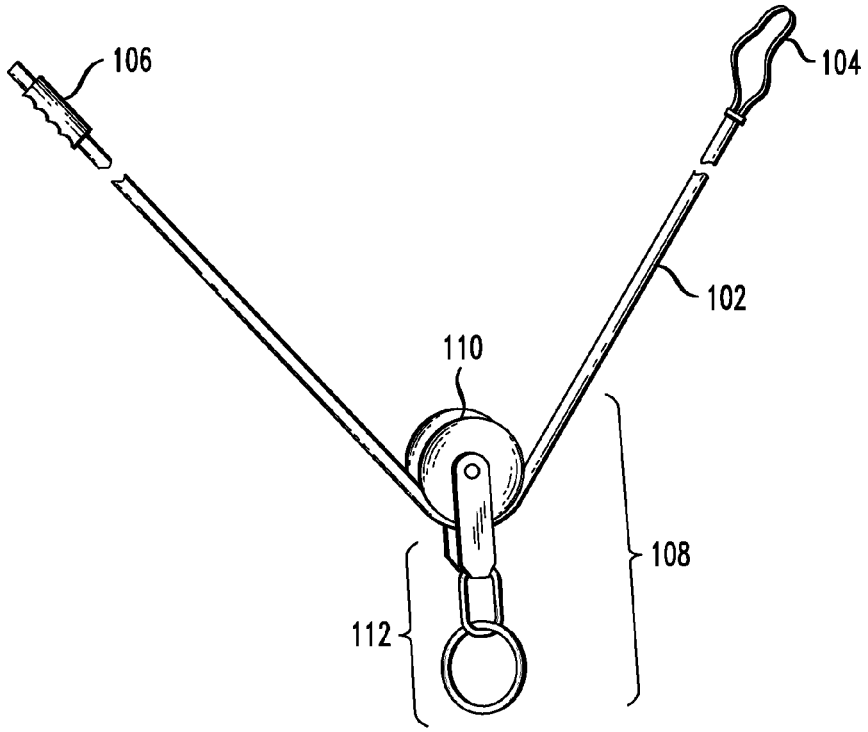
FIG. 1 is a diagram illustrating a leg extension exercise device, according to an embodiment of the present invention.

Referring initially to FIG. 1 a diagram illustrates a leg extension exercise device, according to an embodiment of the present invention. An elongated elastic element 102 is shown having a first end and a second end. Elongated elastic element can be substantially stretched beyond its at-rest configuration. In a preferred embodiment shown in FIG. 1, elongated elastic element 102 is shown as a single length of stretchable rubber tubing. In additional embodiments of the present invention, elongated elastic element 102 may take on different forms and may be composed of different materials, such as, for example, an elastic rubber cord, an elastic fabric cord, and an elastic strap.

At the first end of elongated elastic element 102 is a first body engaging member 104 for a foot of a user. Any mechanism that may securely hold the foot of the user may be utilized, such as, for example, a loop, an adjustable strap, or a stirrup. At the second end of elongated elastic element 102 is a second body engaging member 106 for a hand of the user. Any strap or handle may be utilized at the second end of elongated elastic element 102. Further, second body engaging member 106 may also be slidable and lockable along the length of elongated elastic element 102, so that the user may increase the resistance of elongated elastic element 102 between the hand of the user and the foot of the user. It is also possible for the user to grab elongated elastic element 102 without the assistance of a strap or a handle.

Figure 2:
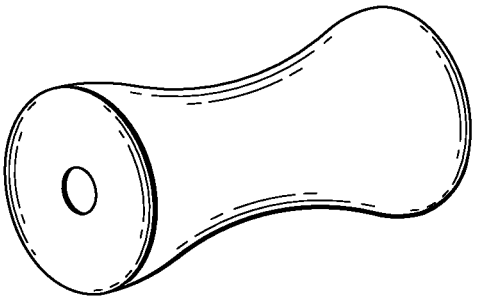
FIG. 2 is a diagram illustrating a first alternative of a rotating body, according to an embodiment of the present invention.
Figure 3:
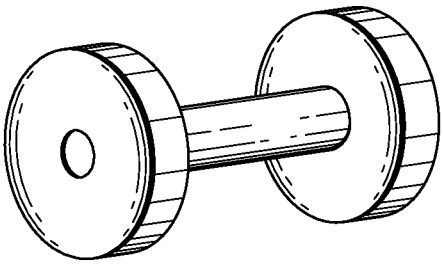
FIG. 3 is a diagram illustrating a second alternative of a rotating body, according to an embodiment of the present invention.

Elongated elastic element 102 is run through a pulley system 108. Pulley system 108 includes a pulley 110 and an engagement mechanism 112. In a preferred embodiment shown in FIG. 1, pulley 110 is wheel-shaped, however any other type of rotating body through which elongated elastic element may be run may also be utilized. Two of many such examples of rotating bodies that may be utilized in pulley system 108 are shown in FIGS. 2 and 3.

Figure 4:
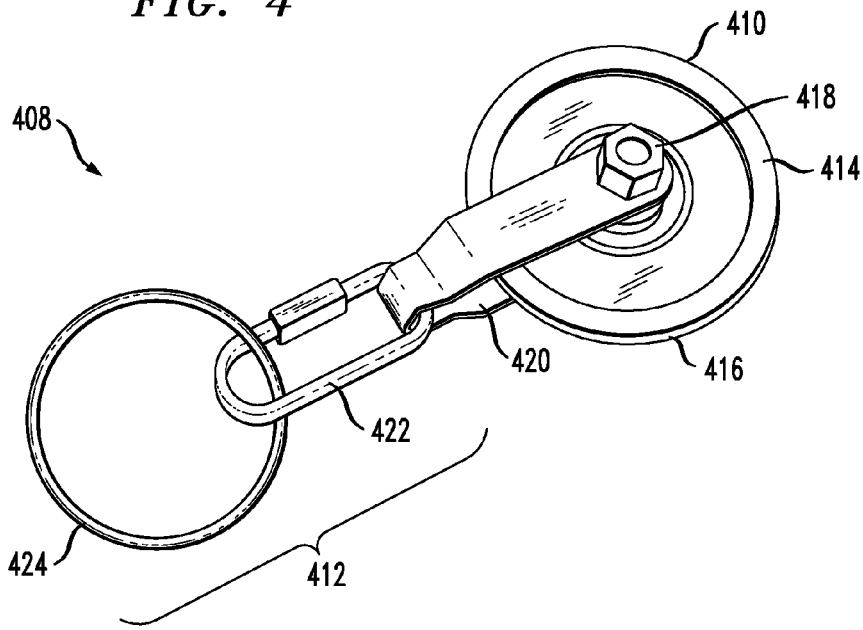
FIG. 4 is a diagram illustrating a pulley system of the leg extension exercise device of FIG. 1, according to an embodiment of the present invention.

Referring now to FIG. 4, a diagram illustrates a pulley system of the leg extension exercise device of FIG. 1, according to an embodiment of the present invention. Pulley system 408 includes a pulley 410 having a wheel 414 with a groove 416 through which elongated elastic element 102, of FIG. 1 runs. Pulley 410 further includes a pin 418 that runs through a central aperture of wheel 414. A housing 420 engages both sides of pin 418, allowing wheel 414 of pulley 410 to turn as elongated elastic element 102 runs through groove 416.

An engagement mechanism 412 of pulley system 408 includes a first element 422 that is removably connected to housing 420 of pulley 410. First element 422 may take the form of any clip or clasping element, such as a carabiner. First element 422 is also connected to a second element 424 of engagement mechanism 412. Second element 424 has a specified width that allows the engagement mechanism 412 to be anchored to a weighted or fixed element. More specifically, in a preferred embodiment, first element 422 may be detached from either housing 420 or second element 424 so that it may pass through an aperture of a weighted element. When engagement mechanism 412 is reattached fully, with second element 424 on an opposing side of the weighted element, the specified width of second element 424 prevents it from passing through the aperture of the weighted or fixed element, thereby anchoring the engagement mechanism to the weighted or fixed element. Further, in a preferred embodiment, engagement mechanism 412 is anchored below the foot of the user when the user is in a seated position, as described in further detail in FIG. 6.

Figure 5:
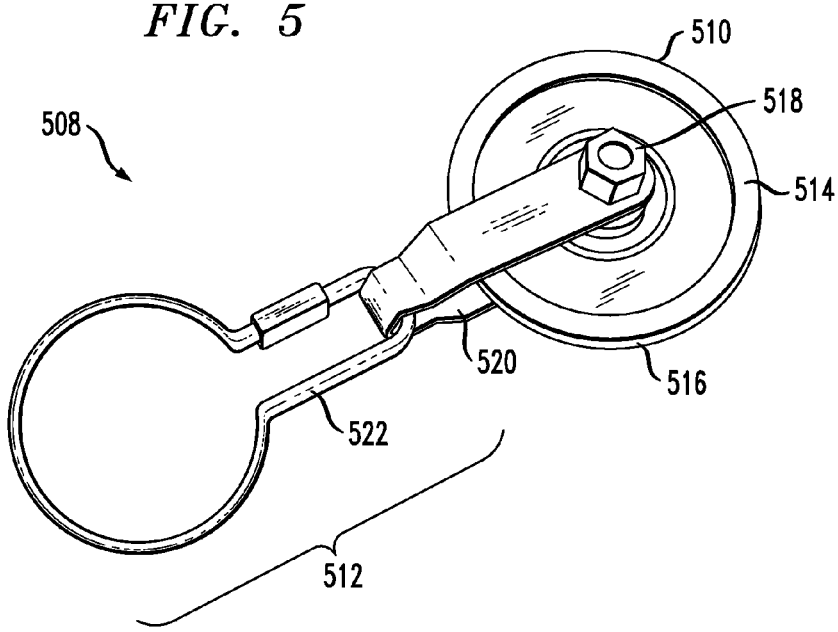
FIG. 5 is a diagram illustrating a pulley system of the leg extension exercise device of FIG. 1, according to an embodiment of the present invention.

Referring now to FIG. 5, a diagram illustrates a pulley system of the leg extension exercise device of FIG. 1, according to another embodiment of the present invention. Pulley system 508 includes a pulley 510 having a wheel 514 with a groove 516 through which elongated elastic element 502 of FIG. 1 runs. Pulley 510 further includes a pin 518 that runs through a central aperture of wheel 514. A housing 520 engages both sides of pin 518, allowing wheel 514 of pulley 510 to turn as elongated elastic element 502 runs through it.

An engagement mechanism 512 of pulley system 508 includes a first element 522 that is removably connected to housing 520 of pulley 510. First element 522 has a specified width that allows the engagement mechanism 512 to anchor to a weighted or fixed element. More specifically, in a preferred embodiment, first element 522 may be detached from housing 520 so that it may pass through an aperture of a weighted or fixed element. When engagement mechanism 512 is reattached fully from an opposing side of the aperture, the specified width of first element 522 prevents it from passing through the aperture of the weighted or fixed element, thereby anchoring engagement mechanism 512 to the weighted or fixed element.

Figure 6:
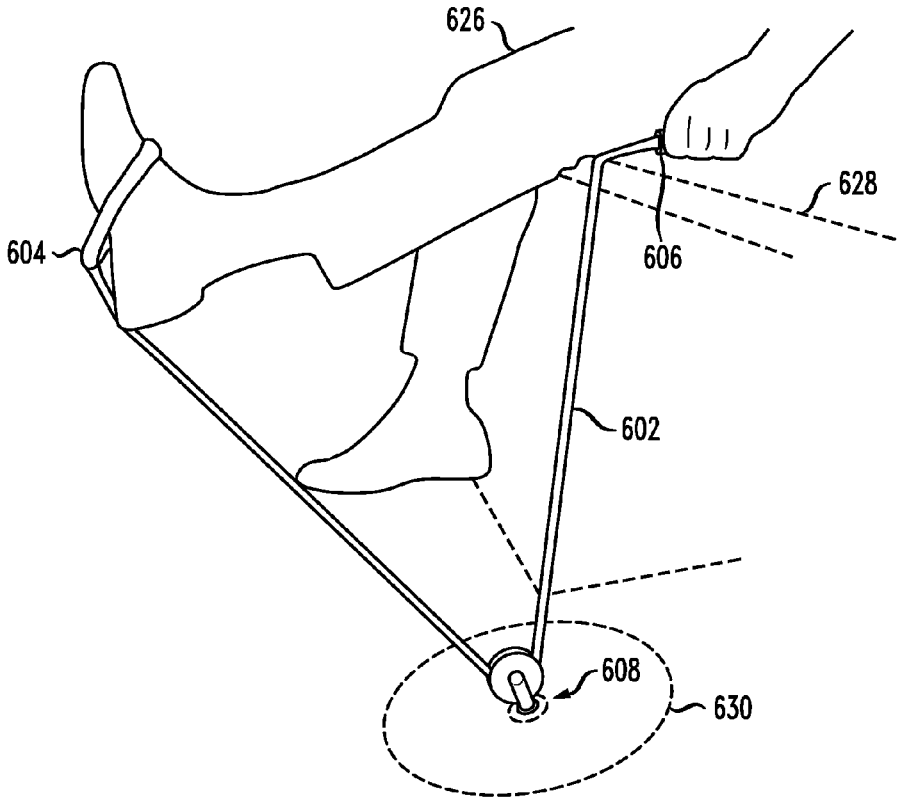
FIG. 6 is a diagram illustrating a leg extension device in connection with a weighted element, according to an embodiment of the present invention.

Referring now to FIG. 6, a diagram illustrates a leg extension exercise device in use with a weighted or fixed element, according to an embodiment of the present invention. A user 626 is seated on an elevated platform 628 such as a desk or a higher chair, so that the user's feet do not reach the floor. A foot of user 626 is inserted in a first body engaging member 604, while a hand of user 626 holds elongated elastic element 602 or a second body engaging member 606, connected to elongated elastic element 602. Elongated elastic element 602 runs through a pulley system 608, which is anchored to a weighted or fixed object 630 on the surface beneath user 626. As elongated elastic element 602 is stretched, it smoothly runs through pulley system 608 to decrease friction. Elongated elastic element 602 allows for gentle yet effective variable resistance. For example, elongated elastic element 602 offers the least resistance when muscles are brought from at the eccentric position, where they are weakest and the knee joint is subject to further injury. As the muscles are contracted and the knee is flexed, the resistance increases as the muscles reach their strongest or contracted position, where the knee is flexed and the leg is straightened. Pulley system 608 also protects elongated elastic element 602 from friction and breakdown over the lifetime of the device. Finally, pulley system 608 allows for smoother contractile performance of the exercise since it allows for substantially frictionless motion.

Examples of a weighted or fixed object 630 may include a weight plate. The device is anchored to a point that may be moved by a user to an exact position that will specifically target the vastus medialis muscle of the knee, and to apply the correct source position for resistance. For example, the weight plate allows for correct bio-mechanical positioning for targeting of a knee strengthening process. The weight plate further conforms to the standard height of tables, bureaus or desks in using the device. The weight plate is also readily accessible in most households and provides a secure anchor without any attachments to the floor itself. As user 626 extends their leg and elongated elastic element is pulled through pulley system 608, pulley system 608 stays stationary and anchored on the surface beneath user 626. Resistance may be adjusted in accordance with where user 626 holds elongated elastic element 602.

Figure 7:
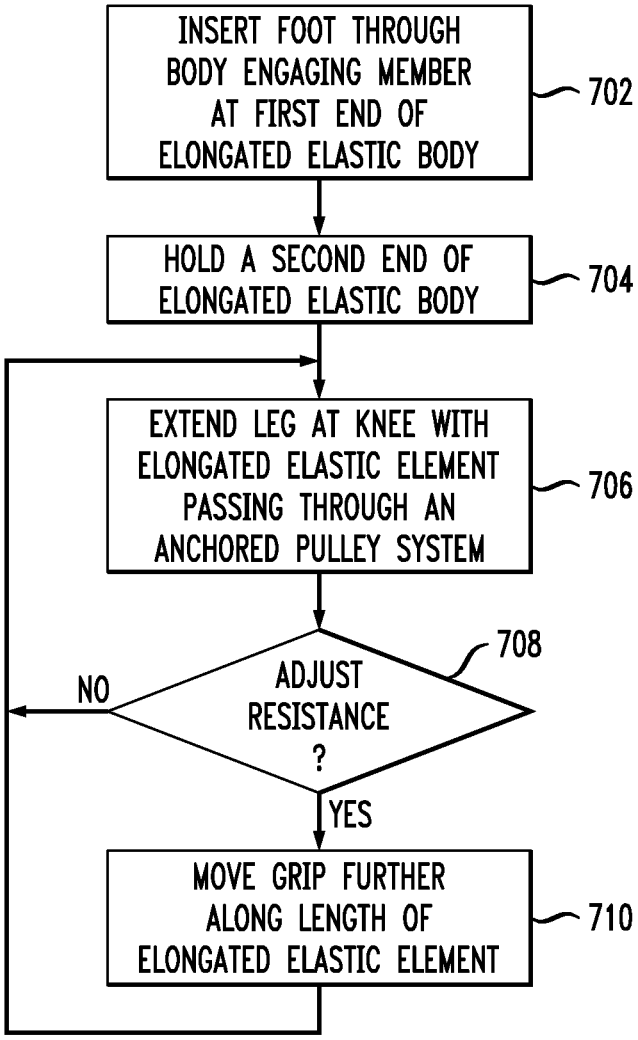
FIG. 7 is a flow diagram illustrating a leg extension exercise methodology, according to an embodiment of the present invention.

Referring now to FIG. 7, a flow diagram illustrates a leg extension exercise methodology, according to an embodiment of the present invention. The methodology begins in block 702 where a user inserts a foot through a body engaging member at a first end of an elongated elastic element stretchable along its length. The user is in an elevated seated position so that the user's feet do not reach the floor. For example, the user may be seated on a table, bureau or desk. In block 704, the user holds a second end of the elongated elastic element. In block 706, the user's leg is extended at the knee so that the elongated elastic element passes through a pulley system anchored to a point on the floor beneath the foot of the user. More specifically, target muscles are contracted that are to be stimulated and progressively overloaded. In block 708, it is determined if it desirable to adjust the resistance of the elongated elastic element. If it is desirable to adjust the resistance of the elongated elastic element, the user's grip may be moved further along the length of the elongated elastic element, in block 710. If the user's grip is moved closer to the second end of the elongated elastic element, resistance will decrease, and if the user's grip is moved further from the second end of the elongated elastic element, resistance will increase. The methodology then returns to block 706, to repeat the exercise. If it is not desirable to adjust the resistance of the elongated elastic element, the methodology returns to block 706 to repeat the exercise. Any desired number of repetitions and sets may be performed depending on the strengthening or rehabilitation program.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method of performing a knee extension exercise comprising the steps of:

inserting a foot of a user through a body engaging member at a first end of an elongated elastic element stretchable along its length so as to provide resistance during the knee extension exercise, wherein the user is in a seated position with the one or more vastus muscles in an eccentric position and the foot elevated above a floor and below a leg of the user;

holding a second end of the elongated elastic element with a hand of the user; and extending the leg of the user at a knee of the user and raising the foot of the user at least by contracting the one or more vastus muscles of the user, so that the elongated elastic element passes through a pulley system as a pulley rotates and provides the resistance from below the knee of the user as the user extends the leg at the knee, wherein the pulley system is removably anchored at the floor by an engagement mechanism to a moveable weighted element and is selectively located at a position substantially below the knee of the user, wherein the resistance strengthens at least the one or more vastus muscles of the user.

2. The method of claim 1, wherein the body engaging member comprises an adjustable strap.

3. The method of claim 1, wherein the elongated elastic element comprises elastic rubber tubing.

4. The method of claim 1, wherein the pulley comprises a wheel having a central aperture, a pin that extends through the central aperture of the wheel, and a housing that engages both sides of the pin allowing for rotation of the wheel.

5. The method of claim 4, wherein the engagement mechanism comprises a first element removably connected to the housing of the pulley, wherein at least a portion of the first element is wider than a defined width such that the first element is prohibited from passing through a specified aperture.

6. The method of claim 4, wherein the engagement mechanism comprises a first element and a second element, wherein the first element is removably connected to the housing of the pulley, and wherein at least a portion of the second element is wider than a defined width such that the second element is prohibited from passing through a specified aperture.

7. The method of claim 1, wherein the weighted element comprises an aperture and the engagement mechanism comprises a first element removably connected to the housing of the pulley, wherein at least a portion of the first element is wider than at least a portion of the aperture such that the at least one element is prohibited from passing through the aperture.

8. The method of claim 1, wherein the weighted element comprises an aperture and the engagement mechanism comprises a first element and a second element, wherein the first element is removably connected to the housing of the pulley and the second element, and wherein at least a portion of the second element is wider than at least a portion of the aperture such that the second element is prohibited from passing through the aperture.

9. The method of claim 1, further comprising the step of adjusting the resistance of the elongated elastic element by moving a grip of the hand of the user along the length of the elongated elastic element.

10. The method of claim 1, wherein the position is a biomechanically correct position for the exercise device with respect to the one or more vastus muscles in the knee extension exercise performed by the user.

11. The method of claim 1, wherein the knee extension exercise targets the one or more vastus muscles.

12. The method of claim 1, wherein the one or more vastus muscles of the user comprise a vastus medalis muscle of the user.

13. The method of claim 1, wherein the body engaging member comprises a stirrup.

14. The method of claim 1, wherein the elongated elastic element comprises an elastic cord.

15. The method of claim 1, wherein the elongated elastic element comprises an elastic strap.

16. The method of claim 9, wherein the adjusting step further comprises the step of increasing the resistance of the elongated elastic element by moving the grip of the hand of the user further from the second end of the elongated elastic element.

17. The method of claim 9, wherein the adjusting step further comprises the step of decreasing the resistance of the elongated elastic element by moving the grip of the hand of the user closer to the second end of the elongated elastic element.

* * * * *